US010602864B2

(12) United States Patent
Smaldone et al.

(10) Patent No.: US 10,602,864 B2
(45) Date of Patent: Mar. 31, 2020

(54) DOUBLE WALL STAINLESS STEEL DRINKING CONTAINER

(71) Applicant: AFJ INDUSTRIES LLC, Rahway, NJ (US)

(72) Inventors: James Smaldone, Brooklyn, NY (US); Daniel Gatto, Brooklyn, NY (US); Al Smaldone, Brooklyn, NY (US)

(73) Assignee: AFJ Industries, LLC, Rahway, NJ (US)

( * ) Notice: Subject to any disclaimer, the term of this patent is extended or adjusted under 35 U.S.C. 154(b) by 0 days.

(21) Appl. No.: 15/799,737

(22) Filed: Oct. 31, 2017

(65) Prior Publication Data

US 2018/0116433 A1 May 3, 2018

Related U.S. Application Data

(60) Provisional application No. 62/415,151, filed on Oct. 31, 2016.

(51) Int. Cl.

| | |
|---|---|
| ***A47G 19/22*** | (2006.01) |
| ***B65D 25/34*** | (2006.01) |
| ***B05D 7/22*** | (2006.01) |
| ***B65D 25/02*** | (2006.01) |

(Continued)

(52) U.S. Cl.

CPC ..... *A47G 19/2288* (2013.01); *A47G 19/2205* (2013.01); *B05D 7/227* (2013.01);

(Continued)

(58) Field of Classification Search

CPC ..... A47G 19/2288; A47G 19/2205; B05D 7/227; B65D 25/02; B65D 25/14; B65D 25/34; B65D 81/3869

(Continued)

(56) References Cited

U.S. PATENT DOCUMENTS 3,603,106 A * 9/1971 Ryan ..... A47G 19/2288 62/457.4

3,813,757 A 6/1974 Bell (Continued)

FOREIGN PATENT DOCUMENTS

JP 3 390 349 1/2003

OTHER PUBLICATIONS

Scott, "The Effect of Coffee Cup Material on Taste", Driftaway Coffee, Wayback Machine, https://driftaway.coffee/effect-coffee-cup-material-taste-ceramic-vs-stainless-steel-vs-plastic Oct. 16, 2016, p. 1 (Year: 2016).*

*Primary Examiner* — Kareen K Thomas

(74) *Attorney, Agent, or Firm* — Fay Kaplun & Marcin, LLP

(57) ABSTRACT

A drinking container having a stainless steel inner wall having an inner surface and an outer surface and a stainless steel outer wall having an inner surface and an outer surface, wherein a gap is formed between the outer surface of the inner wall and the inner surface of the outer wall and wherein a vacuum is pulled in the gap, wherein the outer surface of the outer wall is coated with a ceramic-like sol-gel coating as an outer coating. The drinking container may also include a lower bushing placed along a top side of the bottom surface of the inner wall, a ceramic insert placed over the lower bushing, an upper bushing placed over a top edge of the ceramic insert and a collar locked on one of the inner wall, the outer wall, or a combination thereof, the collar positioned over the upper bushing.

9 Claims, 6 Drawing Sheets

(51) Int. Cl.
*B65D 81/38* (2006.01)
*B65D 25/14* (2006.01)

(52) U.S. Cl.
CPC ..... *B65D 25/02* (2013.01); *B65D 25/14* (2013.01); *B65D 25/34* (2013.01); *B65D 81/3869* (2013.01)

(58) Field of Classification Search
USPC ..... 220/592.17, DIG. 9, DIG. 11, DIG. 14, 220/62.12, 62.15
See application file for complete search history.

(56) References Cited

U.S. PATENT DOCUMENTS

| | | | | |
|---|---|---|---|---|
| 6,041,952 | A * | 3/2000 | Martin | B65D 23/085 215/12.1 |
| 6,065,632 | A * | 5/2000 | Moore, Jr. | A45F 3/16 206/818 |
| 6,206,271 | B1 | 3/2001 | Cho | |
| 6,419,108 | B1 * | 7/2002 | Toida | A47G 19/2288 220/592.17 |
| 2004/0011796 | A1 | 1/2004 | Baba et al. | |
| 2009/0272731 | A1 * | 11/2009 | Olding | C08L 71/00 219/482 |
| 2013/0200064 | A1 * | 8/2013 | Alexander | A47G 19/2288 219/441 |
| 2016/0183704 | A1 * | 6/2016 | Smaldone | A47G 19/2288 220/592.17 |
| 2016/0255986 | A1 * | 9/2016 | Smaldone | A47J 31/20 |
| 2017/0320643 | A1 * | 11/2017 | Green | A47G 19/2272 |

* cited by examiner

DOUBLE WALL STAINLESS STEEL DRINKING CONTAINER

PRIORITY INFORMATION

The present application claims priority to U.S. Provisional Patent Application 62/415,151 filed on Oct. 31, 2016 entitled "Double Wall Stainless Steel Drinking Container having a Ceramic Coated Exterior Wall" naming James Smaldone, Daniel Gatto, and Al Smaldone as inventors, and hereby incorporates, by reference, the entire subject matter of this Provisional Application.

BACKGROUND INFORMATION

People drinking hot or cold beverages prefer that the beverages retain their temperature profile for as long as possible (e.g., a hot beverage remains hot for as long as possible or a cold beverage remains cold for as long as possible). The maintaining of the temperature profile allows individuals to derive more enjoyment from their drinks. For example, a person may brew a hot beverage such as coffee or tea and place that beverage in a container. It may take that person several hours to consume the entirety of the beverage. If the beverage is in an open top container, it will be cold (or warm) by the time the person finishes the beverage and the person will not have the same enjoyment as when the beverage was hot (or cold). Thus, containers with lids are used to help the beverage maintain its original temperature. However, the lids only help to maintain the temperature for a slightly longer time than the open top container.

A container may be manufactured in a variety of different manners. For example, the container may be made of ceramic, plastic, a metallic material, etc. In another example, the container may include a vacuum. In a further example, the container may be made of the metallic material and include a vacuum. However, those skilled in the art will understand drawbacks associated with any of these types of containers. For example, the ceramic container may be fragile and less durable than a container made of plastic. However, the ceramic container may provide better temperature retention than plastic as well as allow for beverages of more extreme degrees of temperature to be placed therein. In another example, the metallic material with the vacuum may provide an even better temperature retention than the ceramic container which, due to its fragility or porosity, may be incapable of holding a vacuum. However, the metallic material may impart an undesired flavor onto the beverage, particularly for hot beverages. In contrast, ceramic containers may not affect the flavor of the beverage, either hot or cold.

SUMMARY

In one exemplary embodiment, a drinking container includes a stainless steel inner wall having an inner surface and an outer surface and a stainless steel outer wall having an inner surface and an outer surface, wherein a gap is formed between the outer surface of the inner wall and the inner surface of the outer wall and wherein a vacuum is pulled in the gap, wherein the outer surface of the outer wall is coated with a ceramic-like sol-gel coating as an outer coating.

In a further exemplary embodiment, a method is described as creating a double walled stainless steel vacuum insulated vessel comprising a stainless steel inner wall having an inner surface and an outer surface and a stainless steel outer wall having an inner surface and an outer surface, wherein a gap is formed between the outer surface of the inner wall and the inner surface of the outer wall and wherein a vacuum is pulled in the gap, determining between a first coating procedure or a second coating procedure is used for an outer coating and an inner coating based on respective curing temperatures and respective maximum heat tolerances of the outer and inner coatings, the first coating procedure including the outer surface of the outer wall being coated as the outer coating prior to the inner surface of the inner wall being coated as the inner coating, the second procedure including the inner coating being coated prior to the outer coating and coating the vessel with the outer coating and the inner coating based on a selected one of the first coating procedure and the second coating procedure.

In still further exemplary embodiments, a drinking container is provided that includes a stainless steel inner wall having an inner surface and an outer surface, the inner wall being shaped to form a space with a side surface and a bottom surface, a stainless steel outer wall having an inner surface and an outer surface, wherein a gap is formed between the outer surface of the inner wall and the inner surface of the outer wall and wherein a vacuum is pulled in the gap, a lower bushing placed along a top side of the bottom surface of the inner wall, a ceramic insert placed over the lower bushing, an upper bushing placed over a top edge of the ceramic insert and a collar locked on one of the inner wall, the outer wall, or a combination thereof, the collar positioned over the upper bushing.

DETAILED DESCRIPTION

Figure 1:
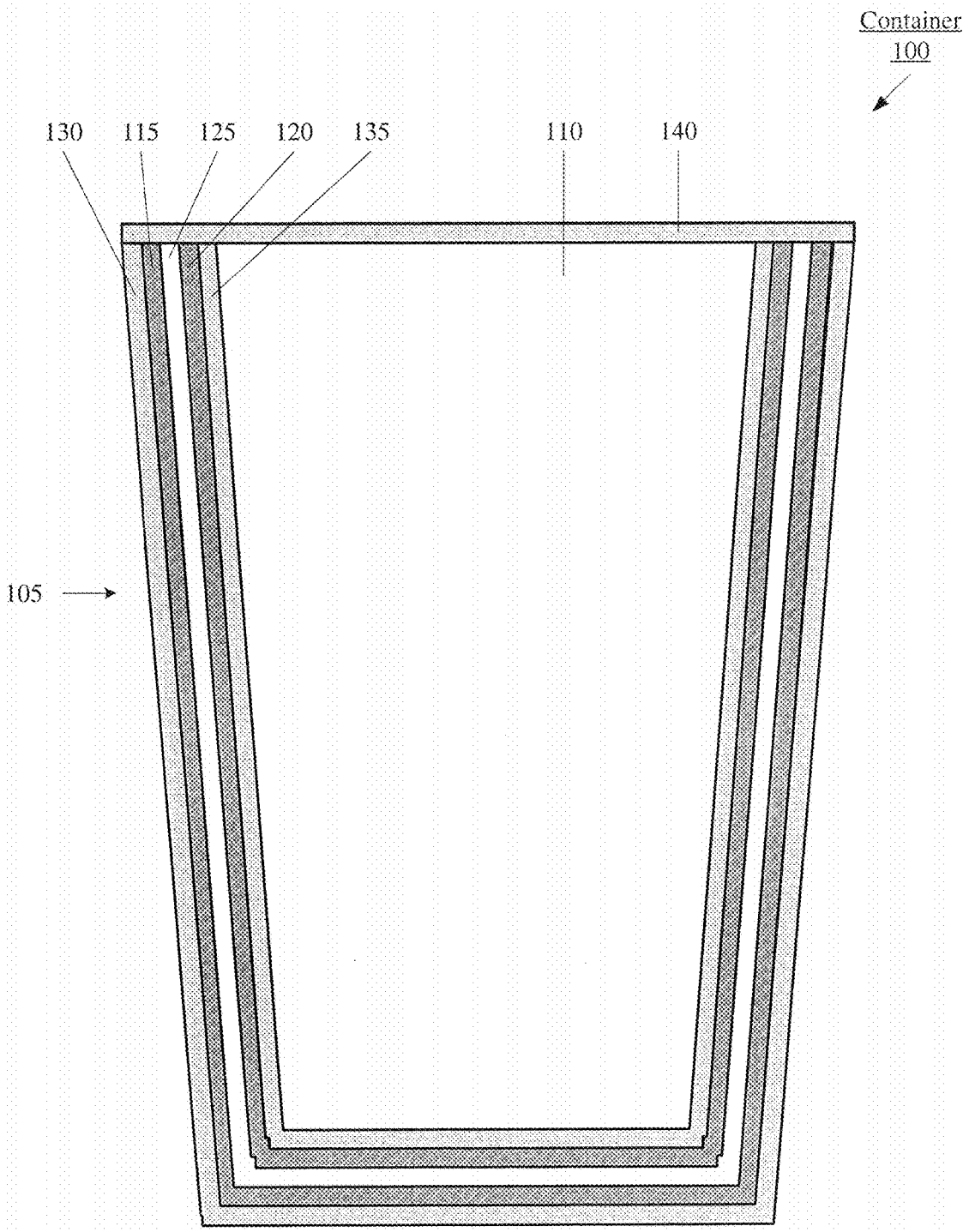
FIG. 1 shows an example first container according to the exemplary embodiments.

The exemplary embodiments may be further understood with reference to the following description and the related appended drawings, wherein like elements are provided with the same reference numerals. The exemplary embodiments describe a drinking container that allows beverages contained in the drinking container to maintain their temperature profile for a longer period of time relative to conventional beverage containers. As will be described in further detail below, the drinking container may include a vacuum and a ceramic or ceramic-like interior that holds the temperature of the beverage at a temperature when the beverage is poured into the drinking container for a longer duration (and decrease a cooling rate). The drinking container according to the exemplary embodiments also provides for a better taste profile of the beverage over other containers. Specifically, the drinking container is configured to prevent a flavor of the beverage to be altered from use of the drinking container.

It should be noted that the exemplary embodiments are described with reference to the drinking container containing a hot beverage and retaining a high temperature of the beverage. However, the temperature being "hot" is only exemplary and it should be understood that the drinking container provides substantially similar features for cold beverages. That is, those skilled in the art will understand that the drinking container of the exemplary embodiments may also keep cold beverages cold for a longer period of time (and decrease a warming rate) and provide for a better taste profile.

It should also be noted that the exemplary embodiments are described with regard to a beverage or drinking container and a beverage or liquid being held therein. However, the container being used for liquids is only exemplary and it should be understood that the drinking container may represent any container in which an item is placed within the container and a temperature of the item is to be retained. For example, the container may also hold solids (e.g., food), gases, a combination thereof, etc. It is also noted that the items may exhibit a temperature that is within an acceptable range of the components of the container.

The exemplary embodiments provide a drinking container that retains a temperature of a beverage held inside the drinking container for an extended period of time relative to a conventional drinking container. The drinking container according to the exemplary embodiments may include a double wall stainless steel vacuum insulated vessel. Furthermore, to prevent altering a taste profile of the beverage, the drinking container may also include a ceramic or ceramic-like interior coupled to the vessel to prevent the stainless steel vessel from imparting a metallic taste. In addition, the ceramic or ceramic-like feature may extend to an exterior of the stainless steel vessel. In this manner, the drinking container of the exemplary embodiments may imitate a ceramic drinking container, provide the advantages associated with using ceramic, stainless steel, and a vacuum, and prevent the disadvantages associated with using ceramic and stainless steel.

FIG. 1 shows an example first container 100 according to the exemplary embodiments. Specifically, FIG. 1 illustrates a longitudinal cross-sectional view of the first container 100. The first container 100 may include a vessel 105 and a space 110 created inside the vessel 105. Initially, it is noted that the vessel 105 exhibiting a cone shape or a longitudinal taper as shown in FIG. 1 is only exemplary. The first container 100 may have any shape longitudinally and/or laterally. For example, the vessel 105 may exhibit any longitudinal shape (e.g., cylindrical, polygonal, etc.) and/or have any lateral cross-sectional shape (e.g., circular, polygonal, etc.).

The drinking container 100 includes an outer wall 115 and an inner wall 120. The outer wall 115 and the inner wall 120 may be constructed from any type of metal. For example, the outer wall 115 and the inner wall 120 may be manufactured with stainless steel which is a common material to be used for drinking containers (e.g., due to its resiliency properties). As shown, the outer wall 115 and the inner wall 120 may form a substantially U-shape in the cross-section extending from a first side to a bottom side to a second side. When positioned properly with the inner wall 120 placed inside the outer wall 115, a gap 125 may be formed between the outer wall 115 and the inner wall 120. A vacuum may be pulled in the gap 125. Those skilled in the art will understand that there are many different manners of constructing the drinking container 100 such that the vessel 105 is created with the outer wall 115 and the inner wall 120 being connected to be structurally sound, but the gap 125 is maintained as a vacuum. This vacuum in the gap 125 may provide an insulation for the drinking container 100. That is, the insulation provided by the vacuum may allow hot beverages held in the drinking container 100 to remain hot and cold drinks to remain cold.

Consumers have reported an issue with the vessel 105 where the outer wall 115 and the inner wall 120 are manufactured with a metal such as stainless steel. Specifically, when an interior surface of the inner wall of the vessel 105 is the metal and the beverage being held in the first container 100 directly contacts this metallic interior surface, the beverage may have an altered taste profile (e.g., a metallic flavor is imparted on the beverage). Thus, consumers have indicated a preference to drink their beverages, especially hot beverages, from ceramic drinking containers. As those skilled in the art will understand, the drinking container being manufactured with a ceramic material that directly contacts the beverage being held has no effect to the taste profile as ceramic is neutral in this regard. However, ceramic drinking containers do not have the same type of insulation properties as the drinking container 100 which is vacuum insulated and therefore do not keep beverages either hot or cold as long as the drinking container 100 which provides the vacuum insulation.

In the exemplary embodiments, an outer surface of the outer wall 115 may include an appropriate substrate that is coated with a ceramic-like sol-gel coating material. Thus, the drinking container 100 may include an outer coating 130. The outer coating 130 may entirely cover an outer surface of the outer wall 115 including both vertical sides and the bottom side. The sol-gel process is a method for producing solid materials from small molecules. The process involves conversion of monomers into a colloidal solution (sol) that acts as the precursor for an integrated network (or gel) of either discrete particles or network polymers. In one exemplary embodiment, the outer coating 130 may be a first type of ceramic-like sol-gel coating material. The outer coating 130 is applied in a single-coat system that provides a remarkably high gloss, much like that of porcelain enamel. Once applied, the outer coating 130 may be taken to extreme temperatures (e.g., 500° C./930° F.), and may be used over direct flame. The outer coating 130 may be cured at a lower temperature (e.g., 280° C./535° F.), thereby using less energy and saving money. The outer coating 130 may be waterborne which means that the handling, mixing, and cleanup are accomplished with water. The outer coating 130 does not require the stainless steel to be pre-heated but the substrate on the outer surface of the outer wall 115 may be warmed (e.g., to 50-60° C./120-140° F.). A dry-film thicknesses of the applied outer coating 130 may be approximately 25 to 70 microns thick (hardness, abrasion resistance and durability improve with increased density). However, the thickness is only exemplary and any thickness may be applied. The outer coating 130 may also have a high pencil hardness preventing the outer coating 130 from being chipped or otherwise removed. This outer coating 130 on the outer surface of the outer wall 115 may provide the appearance of a ceramic drinking container, which will allow the manufacturer to accurately describe the drinking container 100 as a ceramic drinking container, and provide a more sturdy and chip resistant exterior than a normal ceramic drinking container.

In a further exemplary embodiment, an inner surface of the inner wall 120 may include an appropriate substrate that is coated with a ceramic-like sol-gel coating material. Thus, the drinking container 100 may include an inner coating 135. The inner coating 135 may entirely cover an inner surface of the inner wall 120 including both vertical sides and the bottom side. The coating material of the inner coating 135 may be the same as the coating material described above of the outer coating 130 that is applied to the outer surface of the outer wall 115. The coating material of the inner coating 135 may also be a different coating material. Accordingly, the inner coating 135 may be a second type of ceramic-like sol-gel coating material. For example, the coating material of the inner coating 135 applied to the inner surface may be completely free of perfluorooctanoic acid (PFOA) (and polytetrafluroethylene (PTFE)). The inner coating 135 may also be taken to extreme temperatures (e.g., 455° C./850° F.). The inner coating 135 may be waterborne such that handling, mixing, and cleaning are all done with water. The inner coating 135 may cure at a low, energy-saving temperature. Specifically, the curing temperature of the inner coating 135 may be a lower temperature than the curing temperature of the outer coating 130 (e.g., lower than 280° C./535° F.). Since the inner coating 135 will be in contact with the beverage inside the drinking container 100, the inner coating 135 is preferably resistant to stain and a high gloss. The inner coating 135 is also preferably easy to apply and is compliant with EU and US FDA regulations for food contact. The inner coating 135 is also preferably dishwasher-safe. The inner coating 135 may also have a high pencil hardness preventing the inner coating 135 from being chipped or otherwise removed. Thus, if the exemplary embodiment is coated on both the outer surface of the outer wall 115 and the inner surface of the inner wall 120, the drinking container 100 may be marketed as a ceramic-like drinking container.

It should be noted that the outer surface of the outer wall 115 and the inner surface of the inner wall 120 may be prepared to receive the coating. For example, the substrates on the surfaces of the outer wall 115 and inner 120 may be prepared by making sure the surface is free of oils and then surface blasting the surfaces with an abrasive. The removal of oils may prevent contamination of the blasting media which may contribute to improper adhesion of the coating. In one example, the abrasive may be an iron-free alumina (60-100 grit) that is used to obtain a homogeneous surface roughness of Ra=2.5-4.5 microns (μm). A smoother surface may negatively affect both proper adhesion and the mechanical performance of the coating. A rougher surface may cause the product to be drawn into the surface profile, resulting in a dry, rough finish.

It should be noted that other types of coatings may also be used for the outer coating 130, the inner coating 135, or both. In another example of a type of coating, the outer coating 130 and/or the inner coating 135 may be a PTFE coating material. Accordingly, an appropriate substrate may be included in the outer surface of the outer wall 115 and/or the inner surface of the inner wall 120 upon which the PTFE based product is coated. The PTFE coating material may exhibit a plurality of different features in a manner substantially similar to the ceramic-like sol-gel coating material. For example, the PTFE coating material may have a significantly performing non-stick release where liquids and other items being held in the drinking container 100 simply slide off the coating. The non-stick release also lasts a substantial amount of time (e.g., longer than the ceramic-like sol-gel coating material). In another example, the PTFE coating material may be dishwasher-safe, durable by preventing chipping, very easy to clean, chemically resistant, and stain resistant. However, those skilled in the art will understand that the PTFE coating material may not have as high a heat tolerance as the ceramic-like sol-gel coating material (e.g., max heat of 260° C./500° F.). In addition, the FIFE coating material may cure at a flexible curing schedule and temperature (e.g., ambient temperature to 400° C./750° F.). However, those skilled in the art will understand that based on the characteristics of the PTFE coating material, the effectiveness of the PTFE coating material may decrease as the curing temperature being used drops under 343° C./650° F.

It should also be noted that the outer coating 130 being a first ceramic-like sol-gel coating material while the inner coating 135 being a second ceramic-like sol-gel coating material is only exemplary. According to other exemplary embodiments, the outer coating 130 and the inner coating 135 may both be the same ceramic-like sol-gel coating material or any of the aforementioned other types of coatings (e.g., a PTFE coating material). In another example, the coating materials may be swapped to the other surface of the corresponding wall (e.g., the outer coating 130 may be the second ceramic-like sol-gel coating material while the inner coating 135 may be the first ceramic-like sol-gel coating material). In a further example, the outer coating 130 may be a PTFE coating material while the inner coating 135 may be a ceramic-like sol-gel coating material. That is, the outer coating 130 and the inner coating 135 may utilize any combination of the coatings described above. However, to market the drinking container 100 as a ceramic-like drinking container, the outer coating 130 and/or the inner coating 135 may be applied in a manner imitating ceramic.

The first container 100 may also include a collar 140 which circumnavigates a top edge of the vessel 105. Specifically, the collar 140 may be positioned over a top edge of the outer coating 130, the outer wall 115, the gap 125, the inner wall 120, and the inner coating 135. As noted above, the outer wall 115 and the inner wall 120 may be coupled in a manner to maintain a vacuum in the gap 125. For example, the outer wall 115 and/or the inner wall 120 may extend to the other at the top edge of the vessel 105. According to another exemplary embodiment, the vacuum may be maintained in the gap 125 by the outer wall 115, the inner wall 120, and the collar 140. For example, the collar 140 may seal the top edge of the gap 125. The collar 140 may also be coated using any of the coating materials described above. The collar 140 may additionally be configured to receive or couple with a cover or lid (not shown) (e.g., a threading to match a corresponding threading on the cover, a friction fit, a snap fit, etc.). Those skilled in the art will understand that the cover may provide further temperature retention as well as a convenient access in which the beverage may be drunk. It is noted that the cover may utilize the same or a different type of ceramic-like coating. The cover may be constructed from any material such as stainless steel, plastic, etc. This coating on the cover may be applied to all surfaces of the cover that may come in contact with the beverage being held in the first container 100. In this manner, when the first container 100 includes a cover, the user may enjoy the beverage with the beverage having never touched any material except the ceramic-like coating (e.g., the beverage never touches stainless steel, plastic, etc.).

Thus, the above describes the first container 100 which may be marketed as a ceramic-like drinking container. Specifically, the outer surface of the outer wall 115 may appear as a ceramic surface as well as provide substantially similar characteristics as ceramic. The inner surface of the inner wall 120 may also appear as a ceramic surface as well as provide substantially similar characteristics as ceramic. In this manner, the first container 100 according to the exemplary embodiments may include an outer coating 130 on an exterior surface of the vessel 105 and an inner coating 135 on an interior surface of the vessel 105 such that beverages held in the space 110 may retain a temperature via the inner coating 135 and the vacuum insulation of the gap 125 between the outer wall 115 and the inner wall 120.

Figure 2:
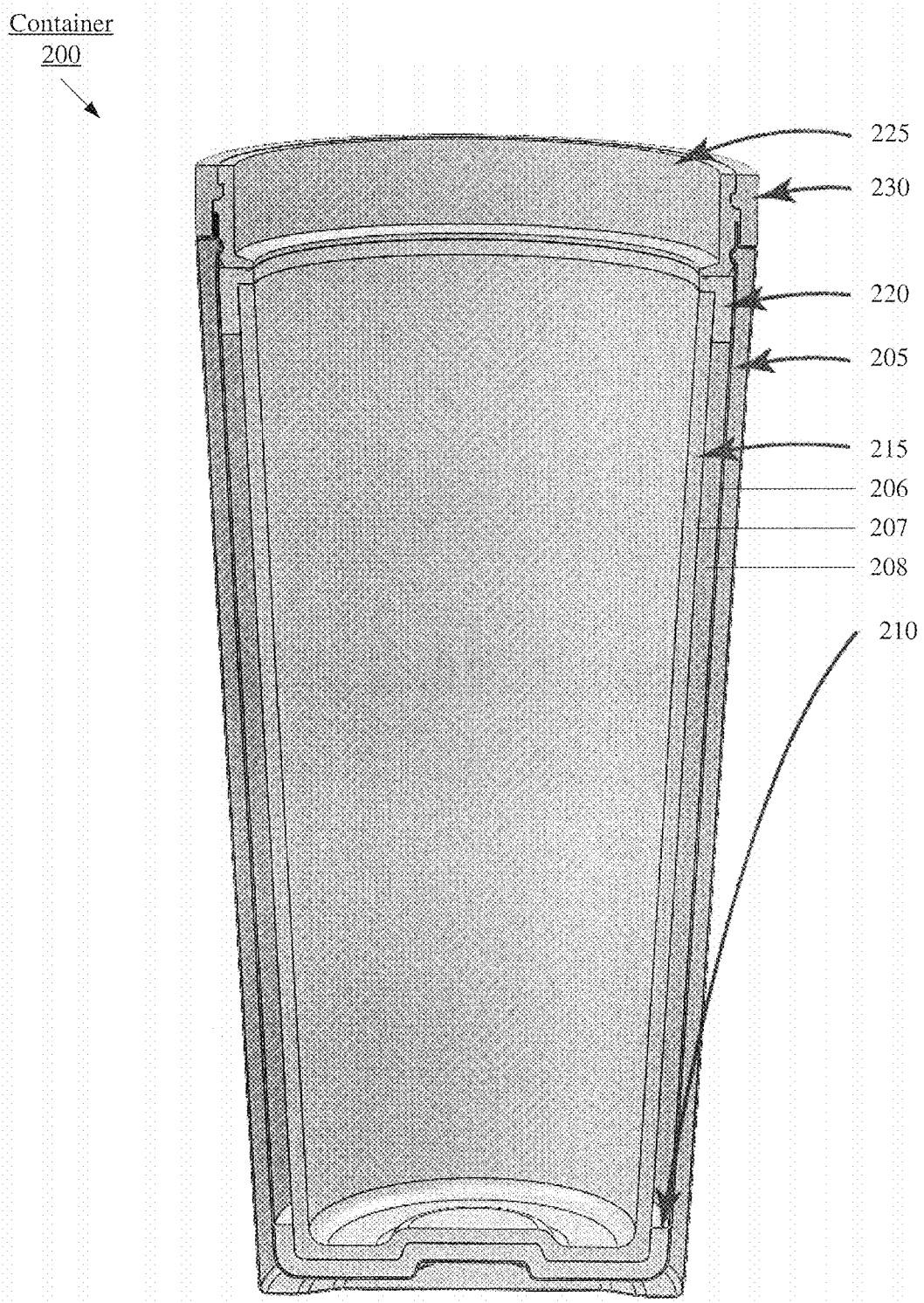
FIG. 2 shows an example second container according to the exemplary embodiments.

FIG. 2 shows an example second container 200 according to the exemplary embodiments. Specifically, FIG. 2 illustrates a longitudinal cross-sectional view of the second container 200. The second container 200 may include a vessel 205. Initially, it is noted that the vessel 205 exhibiting a cone shape or a longitudinal taper as shown in FIG. 2 is only exemplary. The second container 200 may have any shape longitudinally and/or laterally. For example, the vessel 205 may exhibit any longitudinal shape (e.g., cylindrical, polygonal, etc.) and/or have any lateral cross-sectional shape (e.g., circular, polygonal, etc.).

The vessel 205 may include substantially similar components as the vessel 105 of the first container 100. Specifically, the vessel 205 may also include an outer wall 206, an inner wall 207, and a gap 208 therebetween in which a vacuum is pulled as well as these components being manufactured with substantially similar materials. Accordingly, the vessel 205 may be a double wall stainless steel vacuum insulated vessel much like the first container 100. The vessel 205 may also include an outer coating (not shown) on an outer surface of the outer wall 206. Thus, the second container 200 may also be marketed as a ceramic-like drinking container. However, for illustrative purposes, the exemplary embodiments for the second container 200 will be described with no outer coating.

In contrast to the first container 100 which includes the inner coating 135, the second container 200 may include a ceramic insert 215 in the interior space of the vessel 205. Specifically, the ceramic insert 215 is placed into the opening formed by the inner wall 207 of the vessel 205. The ceramic insert 215 may be manufactured with, for example, porcelain. The ceramic insert 215 may be permanently attached to the inner wall 207 of the vessel 205 or may be removable from the second container 200.

The ceramic insert 215 may have a height greater than, equal to, or less than a height of the inner wall 207 and/or the outer wall 206 of the vessel 205. In a first example, the ceramic insert 215 may have a substantially similar height as the inner wall 207 and the outer wall 206 of the vessel 205 or may extend above the top of the inner wall 207 and the outer wall 206 of the vessel 205. In this configuration, a top edge of the ceramic insert 215 may be configured to form a lip, an edge, or a collar for drinking. Accordingly, if used for drinking (e.g., direct contact by the imbiber), the top of the ceramic insert 215 may be smooth or otherwise shaped to provide a pleasant user experience. Furthermore, as noted above with the first container 100, the second container 200 may also be configured to include a cover or a lid in a substantially similar manner as the first container 100. Thus, the top of the ceramic insert 215 (when extending beyond the top of the inner wall 207 and the outer wall 206 of the vessel 205) may include a coupling component for the cover to be coupled to the second container 200 (e.g., threading, friction fit, snap fit, etc.).

In a second example, as illustrated in FIG. 2, the ceramic insert 215 may have a substantially similar height as the inner wall 207 and the outer wall 206 of the vessel 205 or may extend to a height less than the top of the inner wall 207 and the outer wall 206 of the vessel 205. In this configuration, a top edge of the second container 200 may utilize a different mechanism in which a beverage held therein is drunk. Specifically, the second container 200 may include a collar which may be incorporated using an inner collar 225 and an outer collar 230. Prior to the collar being placed, the second container 200 may be assembled to include the ceramic insert 215.

According to an exemplary assembly of the second container 200, a lower bushing 210 may be positioned on a bottom edge of the space inside the double wall stainless steel vacuum insulated stainless portion of the vessel 205. The lower bushing 210 may be manufactured, for example, with silicone. The lower bushing 210 may be manufactured with other materials such that the ceramic insert 215 may be provided a cushioned surface on which to rest. The lower bushing 210 may be sized to substantially correspond to an area of the bottom of the space in the vessel 205. Furthermore, the lower bushing 210 may extend at least partially upward along the side walls of the space in the vessel 205. An upper side of the lower bushing 210 may have a shape that corresponds to a shape of a lower edge of the bushing 220. For example, as shown in FIG. 2, the ceramic insert 215 may include a raised area into a space within the ceramic insert 215. This raised area may create a recess in the bottom side of the ceramic insert 215 from an exterior perspective. The lower bushing 210 may be shaped to fill the recess. The lower busing 210 may also be intact from one edge to another edge. However, the shape of the lower bushing 210 as described above is only exemplary. According to another exemplary embodiment, the lower bushing 210 may be substantially hoop shaped with a hole in a center of the lower bushing 210. The extensions upwards along the side walls of the space in the vessel 205 are also only exemplary. That is, these extensions may be absent, may extend greater than shown in FIG. 2, or may extend less than shown in FIG. 2. The lower bushing 210 may also be smaller than an area of the bottom edge of the space in the vessel 205.

The ceramic insert 215 may then be placed on top of the lower bushing 210 such that a bottom edge of the ceramic insert 215 rests on top of the lower bushing 210. Thereafter, an upper bushing 220 may be placed in the vessel 205 such that the upper bushing 220 rests on a top edge of the ceramic insert 215. The upper bushing 220 may be substantially similar to the lower bushing with regard to material and function. The upper bushing 220 may also be sized to substantially correspond to an area of the upper portion of the space in the vessel 205. The upper bushing 220 may be substantially hoop shaped with an empty area in a center of the upper bushing 220. The upper bushing 220 may also extend downward along the side edges of the vessel 205. However, the shape of the upper bushing 220 as described above is only exemplary and similar modifications as described above for the lower bushing 210 may also be used. It is noted that the upper bushing 220 may always have an empty area in the center so as not to close the vessel 205.

With the outer and inner walls of the vessel 205 extending higher than the ceramic insert 215, a top portion of the vessel 205 may be configured to couple to the inner collar 225 and the outer collar 230. Specifically, a bottom edge of both the inner collar 225 and the outer collar 230 may snap onto the top edge of the vessel 205. Once snapped onto the vessel 205, the inner collar 225 and the outer collar 230 may be permanently coupled to one another to prevent the collar from falling off the vessel 205. For example, after coupling to the vessel 205, the inner collar 225 may be sonic welded to the outer collar 230. The permanent coupling of the collar to the vessel 205 may also trap and protect the ceramic insert between the lower bushing 210 and the upper bushing 220. As shown in FIG. 2, a bottom edge of the inner collar 225 may prevent the upper bushing 220 from falling out of the vessel 205. With the ceramic insert 215 pressed against the bottom edge of the upper bushing 220 and pressed against the top edge of the lower bushing 210, the ceramic insert 215 may be securely placed within the vessel 205.

It is noted that there may be a space between the ceramic insert 215 and an outer surface of the inner wall of the vessel 205. This space may be maintained in a variety of manners. In a first example, this space may be created and left with whatever fluid trapped therein during the assembly process. In a second example, this space may be filled with a silicone buffer such as a substantially similar material as the bushings 210, 220. In a third example, this space may have a vacuum pulled. In a fourth example, air may be used as the insulator in this space.

Thus, the above describes the second container 200 which may be marketed as a ceramic-like drinking container. Specifically, the outer surface of the outer wall of the vessel 205 may appear as a ceramic surface as well as provide substantially similar characteristics as ceramic. The interior of the vessel 205 may include a ceramic insert 215 to provide characteristics associated with ceramic. In this manner, the second container 200 according to the exemplary embodiments may include an outer coating (not shown) on an exterior surface of the vessel 205 and the ceramic insert 215 on an interior surface of the vessel 205 such that beverages held in the space of the vessel 205 may retain a temperature via the ceramic insert 215 and the vacuum insulation of the gap between the outer wall and the inner wall of the vessel 205.

It is noted that the inner collar 225 and the outer collar 230 may also be used as the collar 140 of the first container 100. Thus, a top portion of both the outer wall 115 and the inner wall 120 may be configured to accommodate use of the inner collar 225 and the outer collar 230 to create the collar 140. The outer coating 130 and the inner coating 135 may also be configured to accommodate the inner collar 225 and the outer collar 230 such that the beverage is prevented from contacting the metallic material of the outer wall 115 or the inner wall 120.

Figure 3:
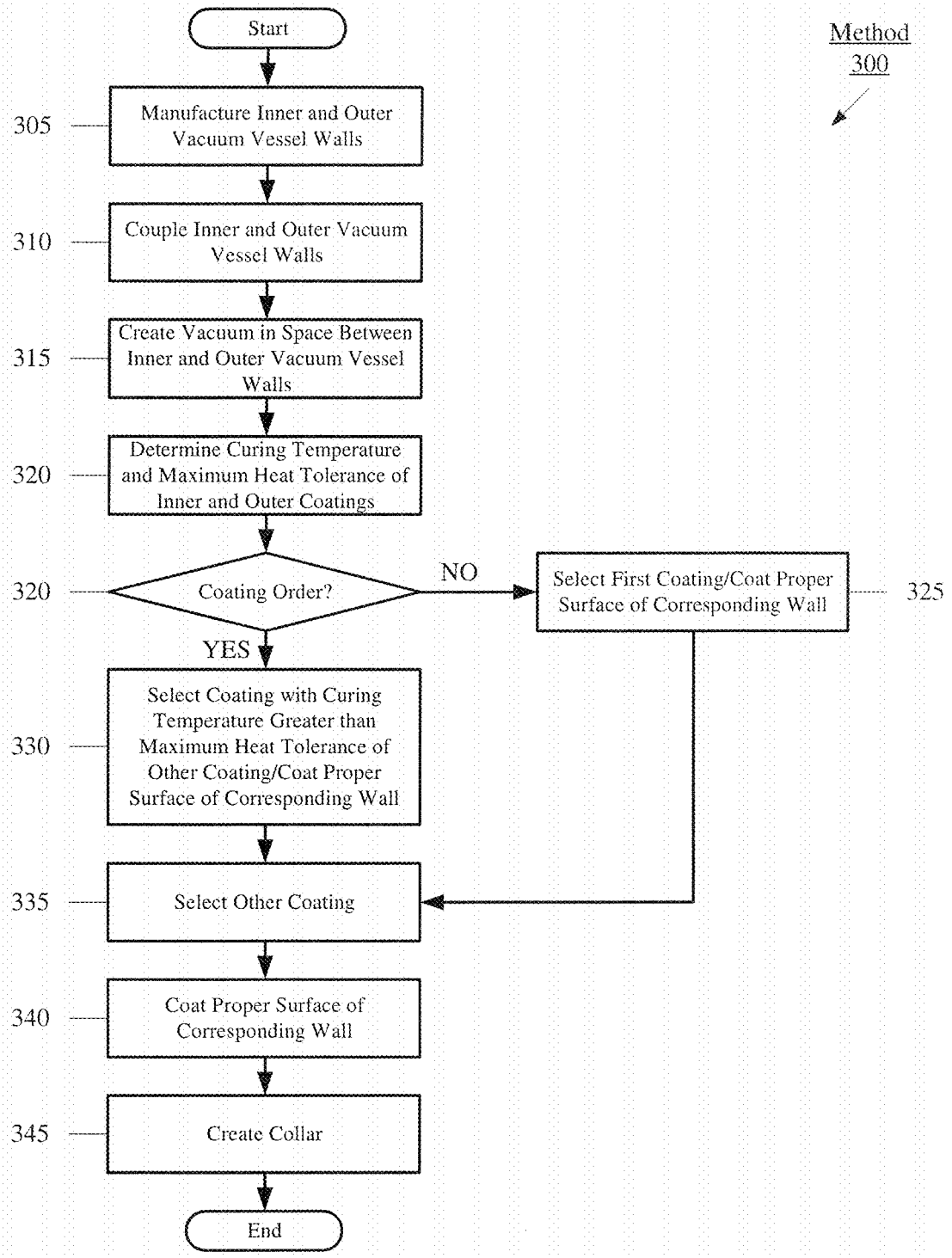
FIG. 3 shows an example method for producing the first container of FIG. 1 according to the exemplary embodiments.

FIG. 3 shows an example method 300 for producing the first container 100 of FIG. 1 according to the exemplary embodiments. As noted above, the first container 100 may include the outer coating 130 and may further include the inner coating 135 with a double walled stainless steel vacuum insulated vessel therebetween such that a ceramic-like drinking container is manufactured. Thus, according to a manufacturing process, in 305, the outer wall 115 and the inner wall 120 are manufactured. In 310, the outer wall 115 is coupled to the inner wall 120 such as along the top edges to create the gap 125 between the side edges and bottom edge of the walls 115, 120. In 315, a vacuum may be pulled from the gap 125. Those skilled in the art will understand the various procedures that may be used to create the double walled stainless steel vacuum insulated vessel.

In 320, the coating with a higher curing temperature is selected. As described above, when the coating is the sol-gel coating material, the curing temperature may be 280° C./535° F. or less than these temperatures. When the coating includes PTFE, the curing temperature may range from an ambient temperature (or alternatively 177° C./350° F.) up to 400° C./750° F. The maximum heat tolerance may also be considered. When the coating is the sol-gel coating material, the maximum heat tolerance may be 500° C./930° F. or 455° C./850° F. When the coating includes PTFE, the maximum heat tolerance may be 260° C./500° F. As can be seen, the curing temperature of the sol-gel coating material may exceed the maximum heat tolerance of the PTFE coating material. Thus, in 320, a determination is made whether a coating order is required as the process of manufacturing the first container 100 may result in affecting or damaging a coating if a reverse coating order is used.

If a coating order is not required, in 325, any first coating is selected. For example, if a first coating is a first ceramic-like sol-gel coating material and a second coating is a second ceramic-like sol-gel coating material, the curing temperature of either may not exceed the maximum heat tolerance of the other. In another example, if the first coating and the second coating uses the same coating material and the curing temperature does not exceed the maximum heat tolerance, the coating order is not required. However, if a coating order is required, in 330, the coating with the curing temperature that exceeds the maximum heat tolerance of the other may be selected first. For example, if a first coating is a ceramic-like sol-gel coating material and a second coating is a PTFE coating material, the PTFE coating material may have a maximum heat tolerance of 500° F. but the ceramic-like sol-gel coating material may be cured at 535° F. In contrast, the PTFE coating material may have a maximum heat tolerance of 930° F. and the PTFE coating material may preferably be cured at 650° F. Thus, it is evident that the ceramic-like sol-gel coating material should be included prior to the PTFE coating material. Once the first coating is selected, the first coating may be included in the first container 100. In 335, the second coating may be selected. In 340, the second coating may be included in the first container 100. Thereafter, with both coatings on the vessel 105, in 345, the collar 140 may be created.

It is noted that the method 300 may be modified to accommodate any combination of curing temperatures and maximum heat tolerances. For example, if the same coating material is used but the curing temperature exceeds the maximum heat tolerance, the method 300 may be modified such that the outer coating 130 and the inner coating 135 are both included simultaneously so that one coating is not already placed prior to curing the other coating.

Figure 4:
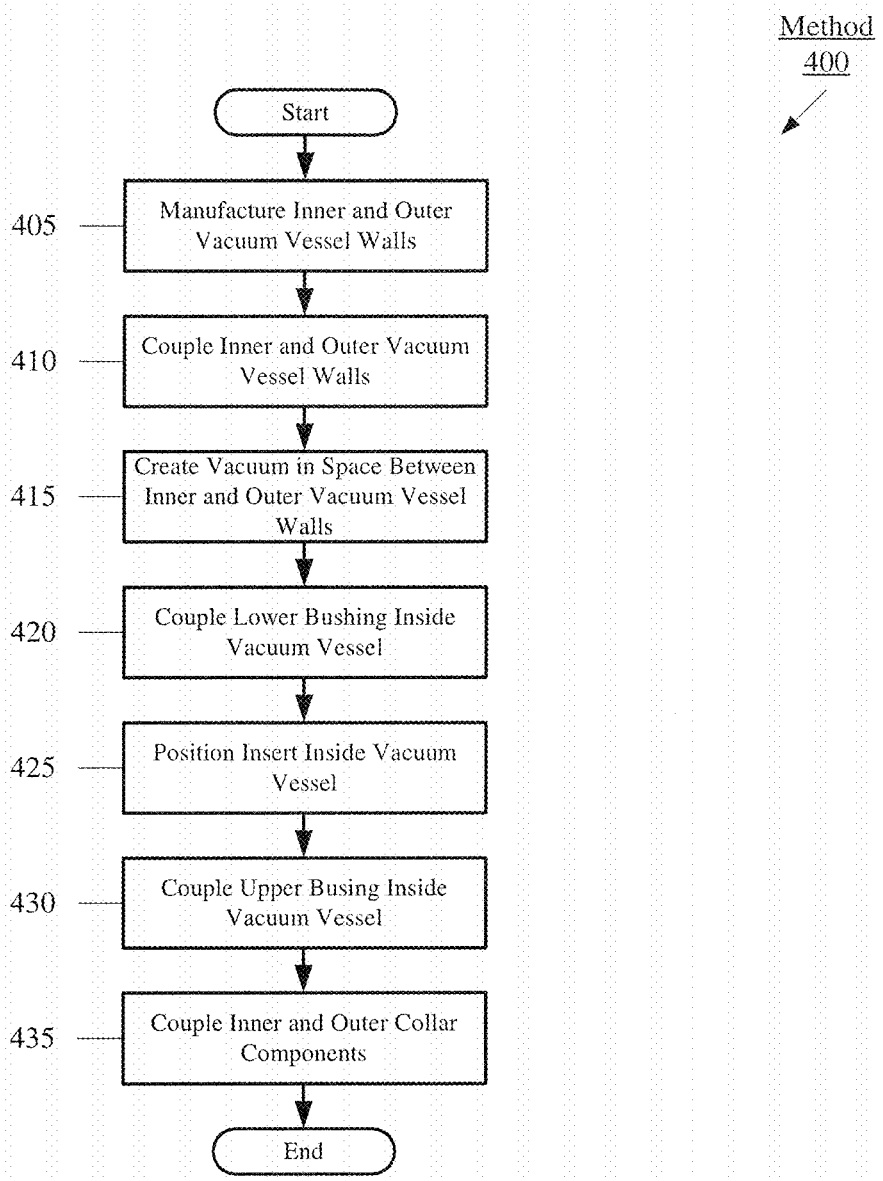
FIG. 4 shows an example method for producing the second container of FIG. 2 according to the exemplary embodiments.

FIG. 4 shows an example method 400 for producing the second container 200 of FIG. 2 according to the exemplary embodiments. As noted above, the second container 200 may include an outer coating and may further include the ceramic insert 215 with a double walled stainless steel vacuum insulated vessel therebetween such that a ceramic-like drinking container is manufactured. Thus, according to an assembly process, in 405, the outer wall 206 and the inner wall 207 of the vessel 205 are manufactured. In 410, the outer wall is coupled to the inner wall such as along the top edges to create a gap between the side edges and bottom edge of the walls. In 415, a vacuum may be pulled from the gap. Those skilled in the art will understand the various procedures that may be used to create the double walled stainless steel vacuum insulated vessel.

In 420, the lower bushing 210 is coupled to a bottom edge of the space in the vessel 205. In 425, the ceramic insert 215 may be positioned inside the space in the vessel 205 and rest on a top surface of the lower bushing 210. In 430, the upper bushing 220 is coupled to a top portion of the space in the vessel 205. In this manner, the ceramic insert 215 is positioned in between the lower bushing 210 and the upper hushing 220. In 435, the collar is created at the top edge of the vessel 205 by coupling the inner collar 225 to the outer collar 230 (e.g., snap fit) and permanently coupling the collar together (e.g., sonic welding). Thus, the ceramic insert 215 may be trapped between the bushings 210, 220.

The exemplary embodiments provide a drinking container that may be marketed as a ceramic-like drinking container. Specifically, an outer coating may be included using a ceramic-like sol-gel coating material to provide an appearance of being made of ceramic while also providing substantially similar properties. However, an interior of the drinking container may include a double walled stainless steel vacuum insulated vessel such that properties associated with this component may also be provided. Furthermore, an inner coating or ceramic insert may be included in the interior of the drinking container to prevent a fluid (or solid) being held in the drinking container from contacting the metallic material of the vessel. The inner coating or the ceramic insert may also provide properties lined to ceramic for fluids (or solids) being held in the drinking container.

The exemplary embodiments also describe an insulated drinking container that allows the beverages contained in the drinking container to maintain their temperature profile for a longer time over conventional beverage containers. The exemplary embodiments also provide for a better taste profile for the beverage over other containers. It should be noted that the exemplary embodiments are described with reference to the insulated drinking container containing a hot beverage, but it should be understood that the insulated drinking container will provide the same advantages for cold beverages, e.g., it will keep the cold beverages cold for a longer period of time and provide for a better taste profile.

Figures 5, 6, 7:
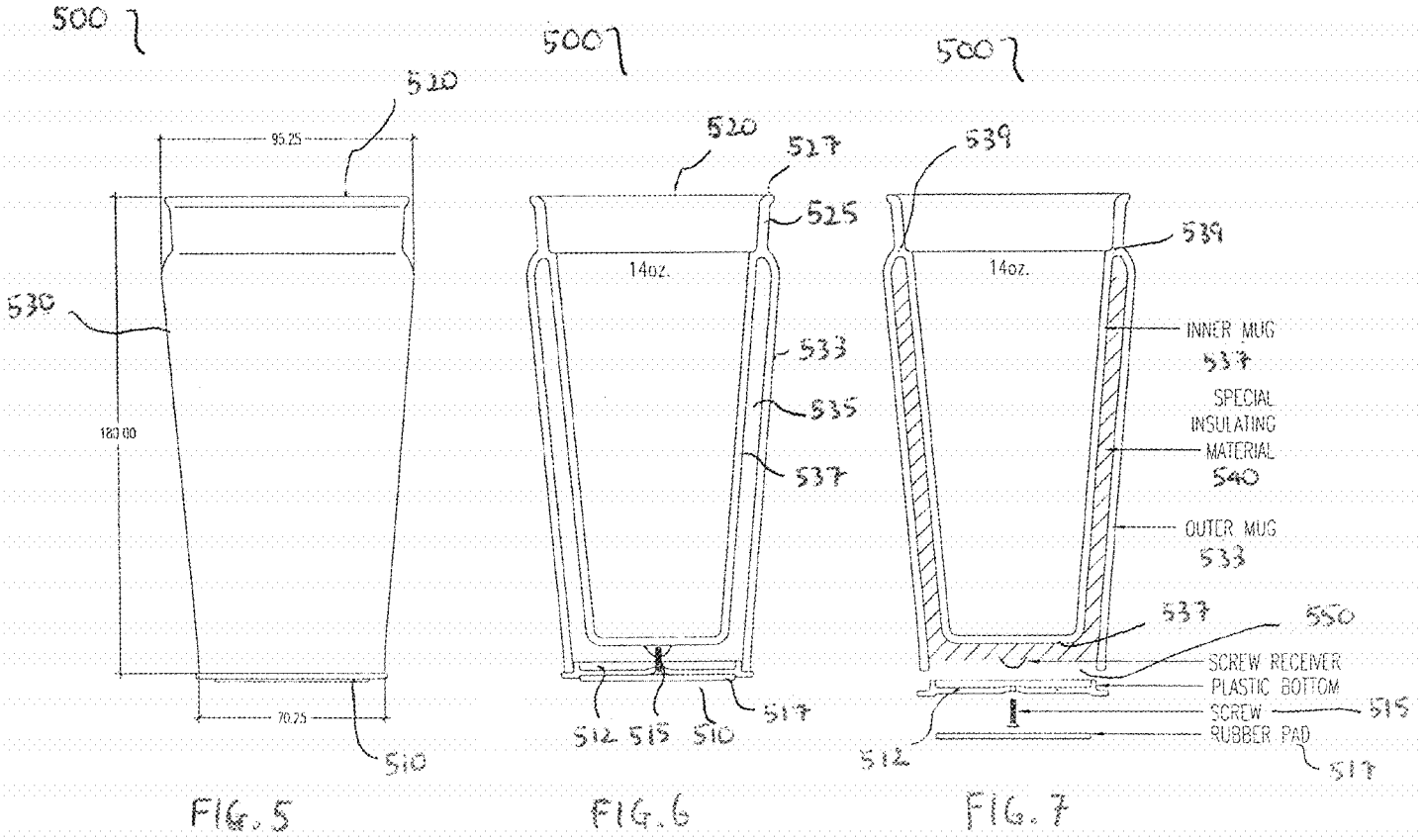
FIG. 5 shows an example insulated drinking container according to the exemplary embodiments.
FIG. 6 shows an example cross-sectional view of the insulated drinking container of FIG. 5 according to the exemplary embodiments.
FIG. 7 shows another example cross-sectional view of the insulated drinking container of FIG. 5 according to the exemplary embodiments.

FIG. 5 shows an exemplary embodiment of an insulated drinking container 500. The insulated drinking container 500 includes a bottom portion 510, a top portion 520 and a sidewall portion 530. FIG. 5 illustrates an exemplary shape and exemplary measurements for the insulated drinking container 500. However, it should be understood that the shape and measurements are only exemplary and the insulated drinking container 500 may take on any shape and have any dimensions.

FIG. 6 shows an exemplary cross-sectional view of the insulated drinking container 500. As shown in FIG. 6, the sidewall portion 530 comprises a pair of walls, outer wall 533 and inner wall 537, with a gap 535 between the walls 533 and 537. The double wall sidewall portion 530 may be constructed of any type of material such as a ceramic, stainless steel, glass, plastic, a composite, etc. As will be described in further detail below, it is also possible that the outer wall 533 is constructed from a different material than the inner wall 537.

The top portion 520 includes a single wall 525, but it is also possible that the double wall structure of the sidewall portion 530 may be extended to the rim 527. It should be understood that the rim 527 is the area from which a person may drink from the insulated drinking container 500. It is further noted that the top portion 520 may also be arranged to receive a lid to seal the insulated drinking container 500. The top portion 520 may be made from the same or a different material as the sidewall portion 530.

The bottom portion 510 may include a bottom seal 512 that is secured to the sidewall portion 530 using a screw 515. The bottom portion 510 may also include a pad 517 that is secured to the bottom seal 512 to hide the screw 515 and provide a surface that may be placed onto desks, tables, etc., such that the insulated drinking container 500 will not scratch the surfaces when placed on the surfaces. The bottom seal 512 may be made from the same or a different material as the sidewall portion 530, while the pad 517 may be made from a material such as plastic, rubber, polyethylene, etc. that will not cause abrasion to a surface on which the insulated drinking container 500 is placed.

FIG. 7 shows a second exemplary cross-sectional view of the insulated drinking container 500. In this view, it is shown that an insulating material 540 is placed into the gap 535 between the inner wall 537 and the outer wall 533. The insulating material may also be placed between the inner wal 537 and the bottom seal 512. The insulating material 540 provides insulating properties that allow beverages or foods placed into the insulated drinking container 500 to maintain their temperature for a longer time (e.g. hot or cold) than without any insulation.

Examples of insulating materials 540 may include quilted or semi-quilted flexible microporous insulation panels. Examples of such materials are the Promat Microtherm (Semi-) Quilted range of products. Another example of insulating material 540 may include a pourable microporous powder such as a pyrogenic silica. Examples of such materials are the Promat Freeflow range of products. In a further example, the insulating materials 540 may be a foam type insulation such as polyurethane blowing agent. Those skilled in the art will understand that such blowing agents may be sprayed into the gap or injected into the gap in a liquid form and may then expand into a foam like substance to provide the insulating characteristics.

Tests using different insulating materials 540 have shown that a hot beverage placed in the insulated drinking container 500 will maintain its temperature profile for 3-6 hours. For example, the generally accepted ideal temperature for drinking coffee is above 155° F. The tests have shown that coffee that is brewed at the recommended temperature of between 195° F.-205° F. that is then placed in the insulated drinking container 100 will maintain the coffee above 155° F. for the above mentioned 3-6 hours depending on the insulating materials 540. Those skilled in the art will also understand the above assumes that a lid is placed on the insulated drinking container 500 to keep the heat from leaving through the opening of the top portion 520.

The following provides an example of a manufacturing process for the insulated drinking container 500. It should be noted that this exemplary manufacturing process is only one example, where the sidewall portion 530 and the top portion 520 are formed from a ceramic material. Other processes may also be used to manufacture ceramic versions of the insulated drinking container 500 and further processes may be used to manufacture insulated drinking containers 500 from other materials.

In a first step, a clay outer mug is formed, e.g., the outer wall 533 of the sidewall portion 530 and the wall 525 of the top portion 520. Then, the inner wall 537 is also formed from clay and the inner wall 537 and the outer wall 533 are joined in the area 539 as shown in FIG. 7. The inner wall 537, the outer wall 533 and the wall 525 of the top portion 520 are baked/fired in a kiln causing the clay to become stoneware. From the opening 550 on the bottom of the mug, the insulating material 540 is placed into the gap 535. As shown in FIG. 7, before the bottom seal 512 is attached to the inner wall 537, there is an opening 550 through which the insulating material 540 may be placed into the gap 535. As described above, if the insulating material is a pourable powder type material or a blowing agent, this may be poured, sprayed or injected into the gap 535 via the opening 550, thereby filling the gap 535. If the insulating material 540 is a quilted panel type material, the material may be forced into the gap 535 via the opening 550. In another exemplary embodiment, the insulating powder may be enclosed in a flexible material (e.g. cloth, paper, plastic, etc.), which may then be inserted into the gap 535 in the same manner as the quilted panel type insulating material. Once the insulating material 540 is placed in the gap 535, the bottom seal 512 is applied using the screw 515 to close off the gap 535. The bottom pad 517 is then added to hide the screw assembly 517 and prevent scratches to desk/tables.

As stated above, the exemplary insulated drinking container 500 also provide a better taste profile than other containers that claim insulating properties because the inner wall 537 is made from a ceramic material. That is, it has been found that drinking hot beverages such as coffee or tea from a ceramic cup is a better experience than drinking from materials such as steel, paper or Styrofoam. However, these other materials may have a better insulating characteristic than ceramic by itself. However, the exemplary insulated drinking container 500 addresses both of these issues. The insulating properties of the insulated drinking container 500 allow for good insulating and temperature characteristics and the use of ceramic for the drinking portion allows for the good taste profile.

Figure 8:
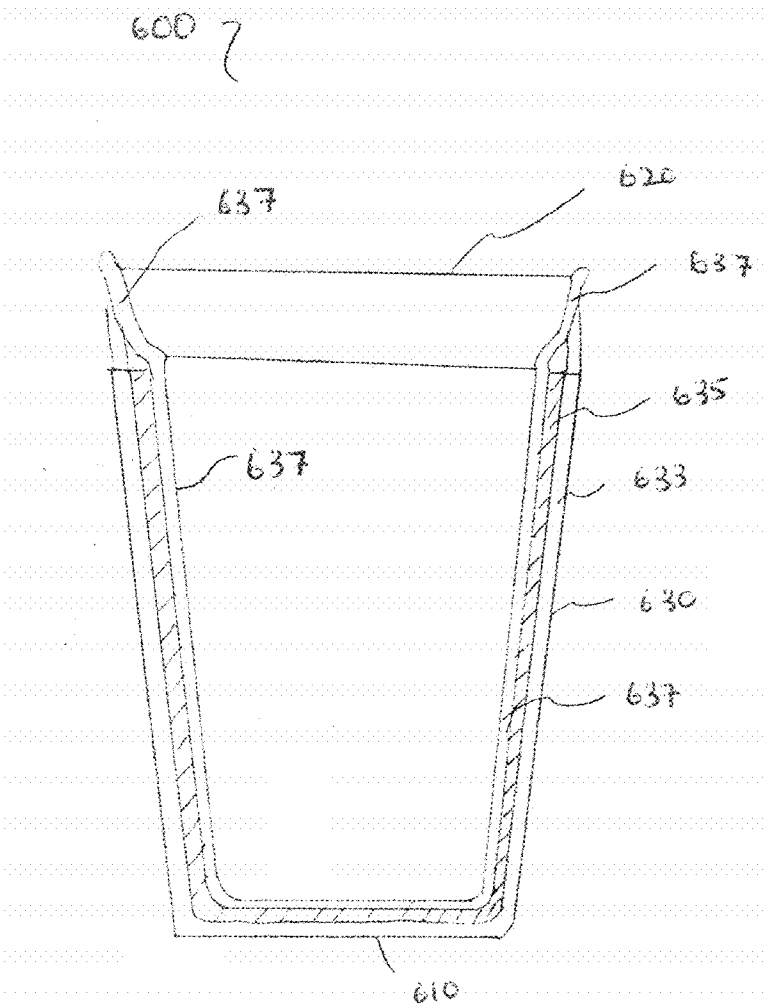
FIG. 8 shows an example cross-sectional view of another example insulated drinking container according to the exemplary embodiments.

FIG. 8 shows a cross sectional view of a second exemplary embodiment of an insulated drinking container 600. The insulated drinking container 600 includes a bottom portion 610, a top portion 620 and a sidewall portion 630. The insulated drinking container 600 further includes an outer wall 633, an inner wall 637 and an insulated gap 635. In this exemplary embodiment, the inner wall 637 is constructed of ceramic. Since the inner wall 637 is the portion of the insulated drinking container 600 that comes in contact with the beverage and from which the person drinks, this exemplary embodiment also has the advantage of providing the advantageous taste profile due to the ceramic. The insulated gap 635 also provides the insulating characteristics that provide the advantageous temperature profile.

However, in this exemplary embodiment, the outer wall 633 is constructed of a different material than the inner wall 637. This different material may be any type of material such as stainless steel, plastic, etc. This different material may allow for a different construction of the insulated drinking container 600 than described above for the insulated drinking container 500. For example, the inner wall 637 may be constructed in the same manner as described above and fired in a kiln to create the stoneware inner wall 637. If the insulated gap 635 is to be insulated with the quilted panel type insulating material or the insulated powder material that is enclosed within another flexible material, this insulating material may be glued or otherwise attached to the inner wall 637. The outer wall 633 may then be attached to the insulation material and/or the inner wall 637 to form the insulated drinking container 600. Again, the outer wall 633 may be attached to the other components by, for example, gluing, molding, pressure fitting, etc., the outer wall 633 to the insulation material and/or the inner wall 637.

If the insulating material is the pourable powder type material or a blowing agent, the outer wall 633 may be attached to the inner wall 637 and then the insulating material may be inserted into the gap 635. In this embodiment, a bottom seal may not be used because the outer wall 633 may be constructed such that it surrounds the entirety of the bottom portion 610. In another embodiment, a mold may be placed around the inner wall to create the gap 635. The mold may be made of any suitable material (e.g., steel, aluminum, a composite, etc.). The mold may have holes or vias through which the pourable powder type insulating material or blowing agent insulating material may be inserted into the gap 635. The mold may then be removed or repositioned and the outer wall 633 may then be attached to the insulation material and/or the inner wall 637 to form the insulated drinking container 600.

It will be apparent to those skilled in the art that various modifications may be made in the present invention, without departing from the spirit or the scope of the invention. Thus, it is intended that the present invention cover modifications and variations of this invention provided they come within the scope of the appended claims and their equivalent.

What is claimed is:

1. A drinking container, comprising:

a stainless steel inner wall having an inner surface and an outer surface; and a stainless steel outer wall having an inner surface and an outer surface, wherein a gap is formed between the outer surface of the inner wall and the inner surface of the outer wall and wherein a vacuum is pulled in the gap, wherein the outer surface of the outer wall is coated with a ceramic-like sol-gel coating as an outer coating, wherein hardness, abrasion resistance and durability of the drinking container is based on a density of the ceramic-like sol-gel coating applied as a dry-film to the outer surface of the outer wall.

2. The drinking container of claim 1, wherein the outer coating has a maximum heat tolerance of 930° F. and has a curing temperature of 535° F.

3. The drinking container of claim 1, wherein the outer coating has a thickness ranging from 25 to 70 microns.

4. The drinking container of claim 1, wherein the outer coating is waterborne and has a hardness to prevent the outer coating from being chipped or otherwise removed.

5. The drinking container of claim 1, wherein the inner surface of the inner wall is coated with a ceramic-like sol-gel coating as an inner coating.

6. The drinking container of claim 5, wherein the inner coating has a maximum heat tolerance of 850° F.

7. The drinking container of claim 5, wherein the inner coating is waterborne and has a hardness to prevent the inner coating from being chipped or otherwise removed.

8. The drinking container of claim 5, wherein the inner coating maintains a taste profile of a fluid stored in the drinking container.

9. The drinking container of claim 1, further comprising:

a lid constructed of a first material, wherein exposed outer surfaces of the lid are coated with a ceramic-like sol-gel coating.

* * * * *